United States Patent [19]

Manusch et al.

[11] Patent Number: 4,468,147

[45] Date of Patent: Aug. 28, 1984

[54] WRITING WICK FOR FELT MARKERS OR PENS

[75] Inventors: Christoph Manusch, Hanover; Wolfgang Kupferschmidt, Wedemark, both of Fed. Rep. of Germany

[73] Assignee: Pelikan Aktiengesellschaft, Hanover, Fed. Rep. of Germany

[21] Appl. No.: 421,026

[22] Filed: Sep. 22, 1982

Related U.S. Application Data

[63] Continuation of Ser. No. 202,770, Oct. 31, 1980, abandoned.

[30] Foreign Application Priority Data

Nov. 15, 1979 [DE] Fed. Rep. of Germany ..... 2946094

[51] Int. Cl.[3] ..... B43K 1/06

[52] U.S. Cl. ..... 401/292; 401/199

[58] Field of Search ..... 401/292, 196, 198, 199

[56] References Cited

U.S. PATENT DOCUMENTS

| | | | |
|---|---|---|---|
| 3,507,600 | 4/1970 | Cress | 401/292 X |
| 3,687,561 | 8/1972 | Phillips | 401/292 X |
| 3,843,270 | 10/1974 | Kiriv et al. | 401/292 |
| 4,072,430 | 2/1978 | Otsuka | 401/292 X |
| 4,076,428 | 2/1978 | Otaki et al. | 401/292 X |
| 4,215,948 | 8/1980 | Horie et al. | 401/292 X |
| 4,310,259 | 1/1982 | Ito et al. | 401/492 X |

*Primary Examiner*—Edward M. Coven

*Attorney, Agent, or Firm*—W. G. Fasse; D. H. Kane, Jr.

[57] ABSTRACT

A writing wick for felt markers and pens is formed by an elongate bundle of individual monofilament thermoplastic strands. Longitudinal channels are defined between the strands. The strands are selectively merged parallel to the direction of the longitudinal axis of the bundle sealing and isolating the longitudinal channels from each other and outwardly enclosing the channels. The longitudinal channels defined by selectively merged strands are operatively interconnected by radial capillary ring grooves (14) or by axially extending capillary incisions 15 penetrating from the outside of the bundle inwardly in the vicinity of the writing tip of the wick. Several longitudinal channel and interconnecting capillary ring grooves (14) or capillary incisions (15) may be used.

7 Claims, 7 Drawing Figures

FIG. 2
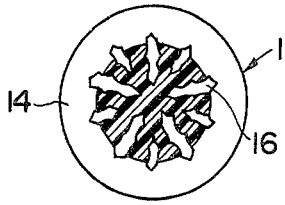
FIG. 5
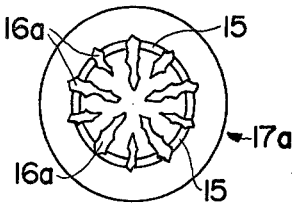
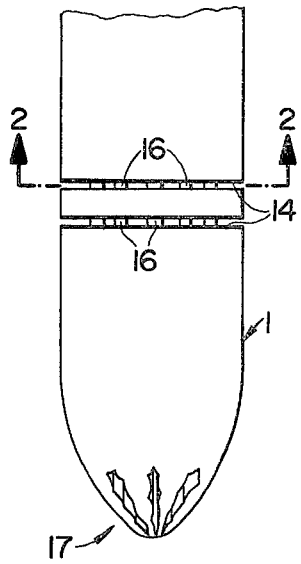
FIG. 1
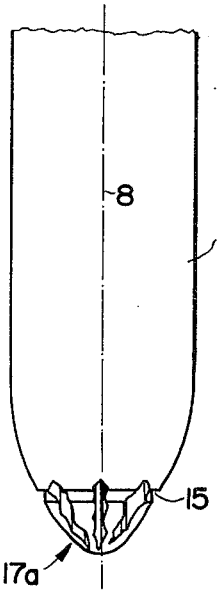
FIG. 4
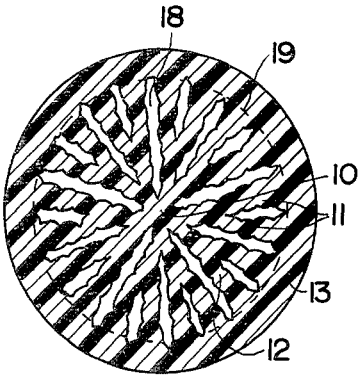
FIG. 3

WRITING WICK FOR FELT MARKERS OR PENS

This is a continuation of application Ser. No.: 202,770 filed Oct. 31, 1980, now abandoned.

CROSS-REFERENCE TO RELATED APPLICATION

The present invention corresponds to German Patent Application No. P 2,946,094.4, filed in the Federal Republic of Germany on Nov. 15, 1979. The priority of said German Patent Application is hereby claimed.

BACKGROUND OF THE INVENTION

This invention relates to writing wicks for felt markers or pens. Such marker wicks are generally made from a bundle of individual monofilament thermoplastic strands in a known manner so that separate and isolated longitudinal capillary channels or chambers are formed between the individual strands. Thus, the individual strands are merged along the direction of the longitudinal axis of the wick in such a way that the longitudinal capillary chambers are not mutually interconnected. That is, the chambers or channels are sealed from each other and from the outside.

It has been found that writing wicks of this type exhibit considerable variation in writing characteristics and qualities due to unavoidable manufacturing tolerances. For technical and economic reasons these tolerances can be reduced only to a certain acceptable minimum but not to an absolute minimum. The factors which influence these tolerances involve a number of considerations. For example, the raw material from which the wicks are made is of importance, particularly the melting point and moisture content have to be considered. The control of the extruder, of the heating zones, and of the temperature as well as the pressure and r.p.m. of the spinning pump influences the writing quality of such wicks. Other factors include the variable degree of contamination of the screens and the control of the temperature of the spinneret head upstream of the spinneret plate as viewed in the fiber flow direction. Downstream of the spinneret plate the variations in the filament withdrawal tension and in the temperatures of the heating and cooling baths may influence the quality of the filament. The foregoing factors superimpose or combine with one another in a multiplicity of statistical variations so that the end product may exhibit random characteristics within an operating range defined by maximum and minimum values which are still acceptable.

OBJECTS OF THE INVENTION

In view of the above it is the aim of the invention to achieve the following objects singly or in combination:

to provide writing wicks for pens and markers which exhibit uniform writing characteristics and qualities despite variations in the tolerances for manufacture of such wicks; and to provide a simple and inexpensive method for forming writing wicks with uniform writing characteristics and qualities.

SUMMARY OF THE INVENTION

It has been found that substantial improvements are not achievable alone through the geometry of the cross-section of such wicks. Rather, according to the approach of the present invention, all longitudinal capillary channels are interconnected at least at one location in the forward zone of the wick by means of inwardly penetrating incisions extending from the outside inwardly.

According to one embodiment, a capillary ring channel operatively interconnects all longitudinal channels adjacent to the writing tip. The ring channel is formed by a radial incision penetrating from the outside inwardly. in another embodiment a capillary ring channel penetrates into the wick in its longitudinal direction from the writing tip.

Additionally, it is advantageous when a plurality of radially extending monofilament strands form capillary channels or chambers of varying radial depth to form the chambers so that they begin in common at the same radial distance from the central axis of the wick, that is, at the inner surface of the outer skin or sheath of the wick. In another alternative, the radially extending monofilament chains may run in spirals or curves toward the central axis. Or, the longitudinal channels or chambers may additionally be subdivided into further capillary spaces by monofilaments centrally suspended from one side along the central axis in the wick.

BRIEF FIGURE DESCRIPTION

In order that the invention may be clearly understood, it will now be described, by way of example, with reference to the accompanying drawings, wherein:

FIG. 1 is a side view of a writing wick according to the invention;

FIG. 2 is a sectional view in the direction of the arrows along section line 2—2 in FIG. 1;

FIG. 3 is a sectional view through a modified embodiment of a writing wick according to the invention;

FIG. 4 is a view similar to that of FIG. 1, but showing an interconnecting capillary channel near the tip of the wick and extending longitudinally;

FIG. 5 is a view in the axial direction toward the tip of FIG. 4;

Figure 6:
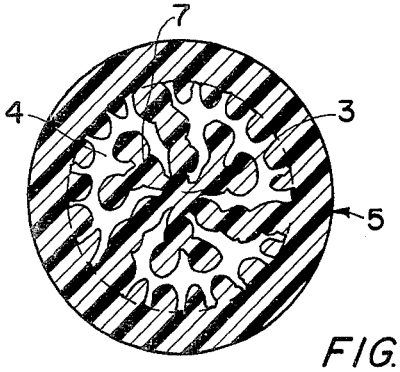
FIG. 6 is a further sectional view through a modified embodiment of a writing wick according to the invention.
Figure 7:
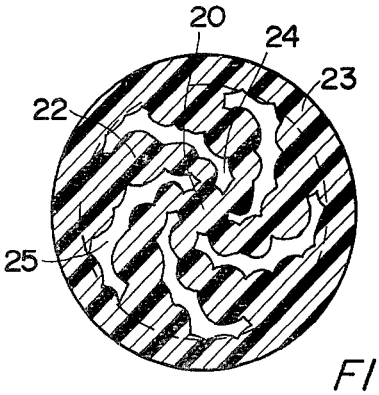
FIG. 7 is a sectional view through yet another embodiment.

DETAILED DESCRIPTION OF PREFERRED EXAMPLE EMBODIMENTS AND OF THE BEST MODE OF THE INVENTION:

FIG. 1 shows such a writing wick 1 with two capillary ring channels 14 which are shown in the form of radial incisions extending from the outside inwardly adjacent the writing tip end 17. The incisions 14 operatively interconnect all longitudinal channels 16 as shown in FIG. 2. The radial incisions or channels 14 are formed to a sufficient depth to engage and communicate with all of the longitudinal inside the wick.

FIG. 4 shows another writing wick 1*a* in which the capillary ring channel 15 is impressed or formed in the longitudinal direction of the wick from its writing tip 17*a*. The top plan view appears as in FIG. 5, showing the interconnecting of longitudinal channels 16*a* by the annular channel 15.

FIG. 3 shows a sectional view through yet another wick 10 in which a plurality of radially extending monofilament chains 11, 12 composed of the merged monofilament strands form a plurality of capillary channels or chambers 18 of varying and differing radial depth. However, all of the channels in the radial direction begin uniformly at the inner imaginary surface 19 of the outer skin 13 of the wick 10. In the case of a radially extending capillary ring channel 14, the radial incision extends through the outer sheath or skin 13 at least to the depth of the inner imaginary surface 19 of the skin. In the case of a longitudinally extending capillary ring channel 15 of the kind shown in FIGS. 4 and 5, the incision extends coaxially at a radius from the central axis 8 no greater than the inner surface 19 of the skin 13.

FIG. 6 shows a sectional view of a writing wick embodiment in which the longitudinal channels 4 are further subdivided into capillary dimension spaces by monofilaments 7 connected or suspended in the wick 5 from one side only along the central axis 3 of the wick.

FIG. 6 shows a sectional view in which the radially extending monofilament chains 22 composed of the merged monofilament strands, extend in spiral shapes or curves toward the central axis 20 of the writing wick, whereby a positive ink supply to all longitudinal capillary channels 16 in the wick is assured. Separate longitudinal channels 24, 25 of spiral or curved configuration extending in the radial direction from the outer skin or sheath 23 to the central axis 20 are thereby formed.

An additional advantage of the invention, especially for the embodiment according to FIG. 1, is that the capillary incision sufficiently close to the writing tip imparts a certain springiness to the writing tip relative to the surface on which the tip is used for writing. This feature affords a particularly pleasing and advantageous writing tip response when such tips are used for marking or writing. Additionally, the resilient movement of the tip opens the capillary grooves so that any ink residues or remainders are mechanically loosened and rinsed out by the overflowing ink said rinsing or cleaning being aided by the capillary incision forming the ring channel 15 closest to the tip or directly adjacent to the tip.

Although the invention has been described with reference to specific example embodiments, it will be appreciated, that it is intended to cover all modifications and equivalents within the scope of the appended claims.

What is claimed is:

1. A writing wick having a writing tip portion and a longitudinal central axis and an outer surface for felt markers and pens, comprising an elongate bundle of a plurality of individual monofilament thermoplastic strands defining longitudinal capillary channels between said monofilament thermoplastic strands, said longitudinal capillary channels having radially inner ends spaced from said longitudinal central axis, whereby all of said longitudinal capillary channels are separated and fully closed off from one another inside said wick around said central axis, said longitudinal capillary channels having radially outer ends all of which are substantially uniformly spaced from said outer surface of the wick, whereby the longitudinal capillary channels are outwardly enclosed by said monofilament thermoplastic strands forming an outer skin between said outer surface of the wick and said outer ends of said longitudinal capillary channels, and at least two ring type capillary ducts in said outer skin penetrating from said outer surface inwardly, one of said ring type capillary ducts being located in said bundle sufficiently close to said writing tip of the wick for imparting a certain springiness to the writing tip, both of said ring type capillary ducts extending inwardly to a depth sufficient to operatively interconnect all of said longitudinal capillary channels to one another inside the wick at least at two locations along the wick for positively supplying all longitudinal capillary channels with ink, the other of said capillary ring type ducts being located in said writing tip portion for also aiding in keeping the tip clean when the tip moves due to said springiness.

2. The writing wick of claim 1, wherein at least one of said ring type capillary ducts penetrates the bundle from the outer surface of the bundle inwardly in a radial direction.

3. The writing wick of claim 1, wherein said other of said capillary ring type ducts adjacent to said writing tip comprises a capillary ring channel (15) penetrating from near the writing tip of the wick inwardly in the direction of said longitudinal central axis and substantially concentrically to said longitudinal central axis.

4. The writing wick of claim 2 or 3, wherein the plurality of monofilament strands form said longitudinal capillary channels to have different depths in the radial direction.

5. The writing wick of claim 1, wherein said monofilament thermoplastic strands are shaped to form radially directed monofilament chains extending spirally toward the central axis of the bundle to thereby form spiralling longitudinal capillary channels.

6. The writing wick of claim 1, further comprising strands connected or suspended at only one side along the longitudinal direction at the center of the bundle thereby subdividing the longitudinal capillary channels into further capillary spaces.

7. The writing wick of claim 2 or 3, wherein said ring type capillary ducts comprise incisions extending radially into said wick.

* * * * *